US006168098B1

(12) United States Patent
Brinn, Jr.

(10) Patent No.: US 6,168,098 B1
(45) Date of Patent: Jan. 2, 2001

(54) FUEL INJECTOR WITH TUBULAR LOWER NEEDLE GUIDE

(75) Inventor: Benjamin F. Brinn, Jr., Williamsburg, VA (US)

(73) Assignee: Siemens Automotive Corporation, Auburn Hills, MI (US)

( * ) Notice: Under 35 U.S.C. 154(b), the term of this patent shall be extended for 0 days.

(21) Appl. No.: 09/328,762

(22) Filed: Jun. 9, 1999

(51) Int. Cl.[7] ..... F02M 59/00
(52) U.S. Cl. ..... 239/585.4
(58) Field of Search ..... 239/585.1–585.5, 239/583; 251/129.21, 127, 318

(56) References Cited

U.S. PATENT DOCUMENTS 4,597,558 * 7/1986 Hafner et al. ..... 239/585.1
5,016,819 * 5/1991 Wood ..... 239/585.1
5,207,384 * 5/1993 Horsting ..... 239/585.4 X
5,236,173 * 8/1993 Wakeman ..... 239/585.3 X
5,255,855 * 10/1993 Maier et al. ..... 239/585.1 X
5,875,972 * 3/1999 Ren et al. ..... 239/585.4
5,887,798 * 3/1999 Ohta et al. ..... 239/585.1
5,921,473 * 7/1999 Romann ..... 239/585.1

* cited by examiner

*Primary Examiner*—Kevin Weldon

(57) ABSTRACT

A solenoid actuated fuel injector comprises a valve body having a longitudinal axis. A valve seat subassembly is mounted in one end of the valve body. The valve seat subassembly includes a valve seat having a seating surface and a circumferential sealing surface surrounding the seating surface. The valve seat subassembly also includes a lower needle guide and swirl disk welded to the valve seat. The lower guide includes a flange portion and a tube portion having an axially disposed tubular bore for guiding the needle in a tight tolerance relationship. The tubular bore provides a longer length interface with the needle and a smoother wear surface than a conventional pierced hole thin lower guide.

7 Claims, 3 Drawing Sheets

FUEL INJECTOR WITH TUBULAR LOWER NEEDLE GUIDE

FIELD OF THE INVENTION

This invention relates to needle type solenoid operated fuel injectors for controlling the injection of fuel into an internal combustion engine and more particularly to a fuel injector for direct injection of fuel into the engine.

BACKGROUND OF THE INVENTION

It is known in the fuel injection art to utilize a needle within a solenoid operated fuel injector to close a fuel passageway in a valve seat. In such injectors, a pierced hole thin lower guide aligns and supports the needle during movement. The pierced hole typically has a breakout which leaves a very small (thin) guide surface. Also, the needle has occasion to wear due to the sharp thin punched hole. This wear reduces alignment, allows fuel flow around the needle and may, initiate or contribute to fuel leakage. Misalignment results in the needle striking the cone of the sealing surface and sliding along the cone edge before being guided into the seal position and closing the flow port. Friction between the needle and the cone delays closing and disrupts the uniform spray pattern prior to complete shut off. A similar delay in developing a uniform spray pattern occurs as the needle is lifted out of the seal position.

SUMMARY OF THE INVENTION

The present invention provides a solenoid actuated fuel injector having improved axial alignment of a needle with a valve seat, reducing initial and long term leakage, resulting in improved manufacturing yield and extended life durability.

According to the invention, the solenoid actuated fuel injector comprises a valve body having a longitudinal axis. A valve seat subassembly is mounted in one end of the valve body. The valve seat subassembly includes a valve seat having a seating surface and a circumferential sealing surface surrounding the seating surface. The sealing and seating surfaces face the interior of the valve body. The seating surface includes a fuel outlet opening centered on the axis and in communication with means for conducting pressurized fuel into the valve body against the seating surface.

A needle having an end is moveable between a seated position, wherein the end is urged against the seating surface to close the outlet opening against fuel flow, and an open position, wherein the end is spaced from the seating surface to allow fuel flow through the outlet opening. Biasing means in the valve body is provided for biasing the needle toward the seated position.

The valve seat subassembly also includes a lover needle guide. The lower needle guide includes a flange portion and a tube portion having an axially disposed tubular bore for guiding the needle. The tubular bore provides a longer length interface with the needle and a smoother wear surface than a conventional pierced hole thin lower guide.

The lower guide also includes a plurality of fuel flow holes in the flange spaced around the tubular bore. The tube portion extends from the flange toward the inside of the valve body.

In an exemplary embodiment, a swirl disk is sandwiched between the valve seat sealing surface and the lower guide flange. The swirl disk receives fuel from the plurality of fuel flow holes in the lower guide flange and distributes the fuel to the valve seat fuel outlet opening.

The valve seat subassembly can be assembled on a weld guide that aligns the valve seat, swirl disk, and lower guide against a shoulder in the end of the valve body, and the nose of the valve body is crimped to hold the seat subassembly in the valve body and the valve seat is laser welded in the end of the valve body mounting the subassembly therein.

These and other features and advantages of the invention will be more fully understood from the following detailed description of the invention taken together with the accompanying drawings.

DETAILED DESCRIPTION OF THE INVENTION

Figure 1:
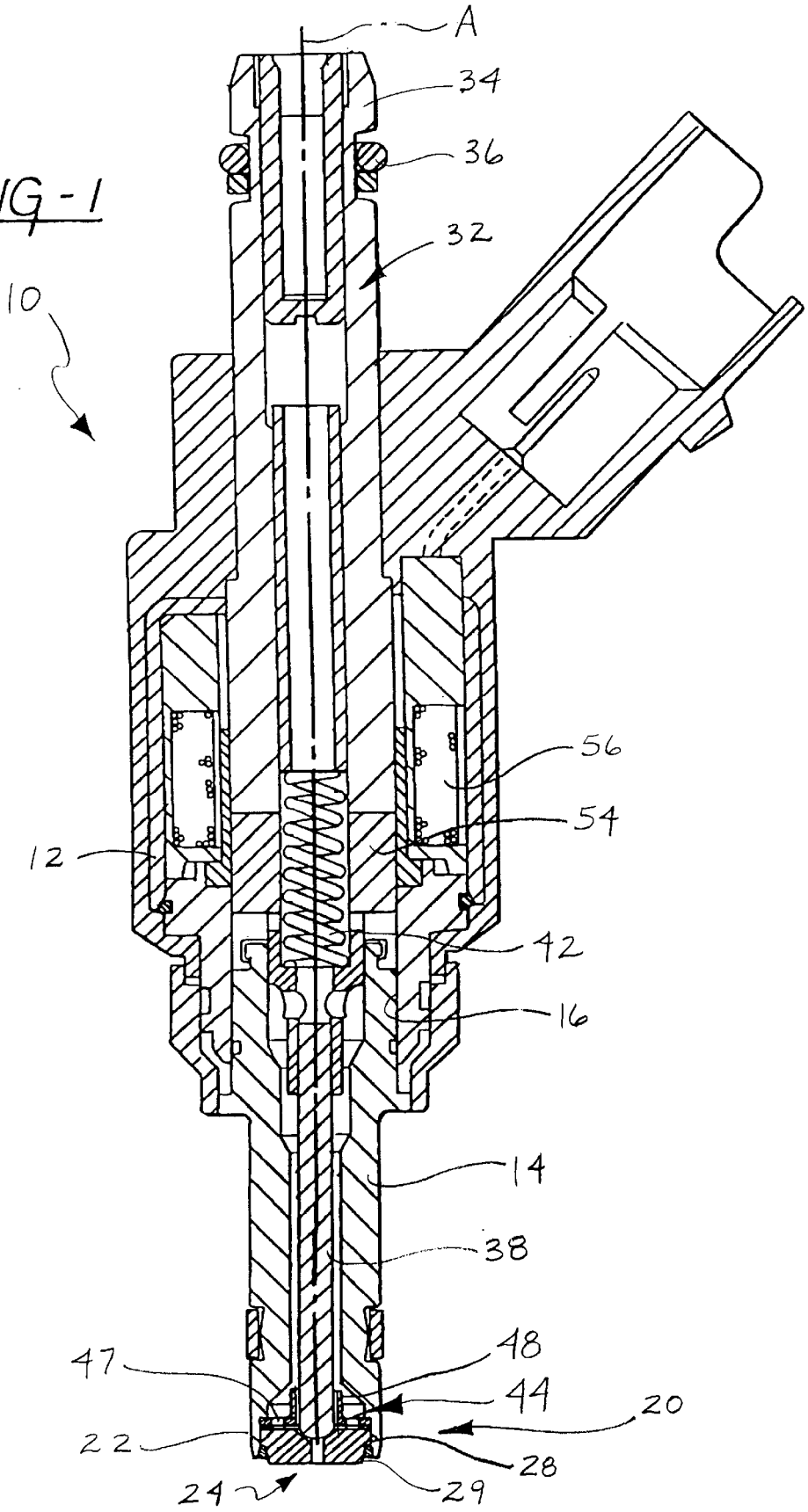
FIG. 1 is a sectional view of a solenoid actuated fuel injector constructed in accordance with the present invention.
Figure 2:
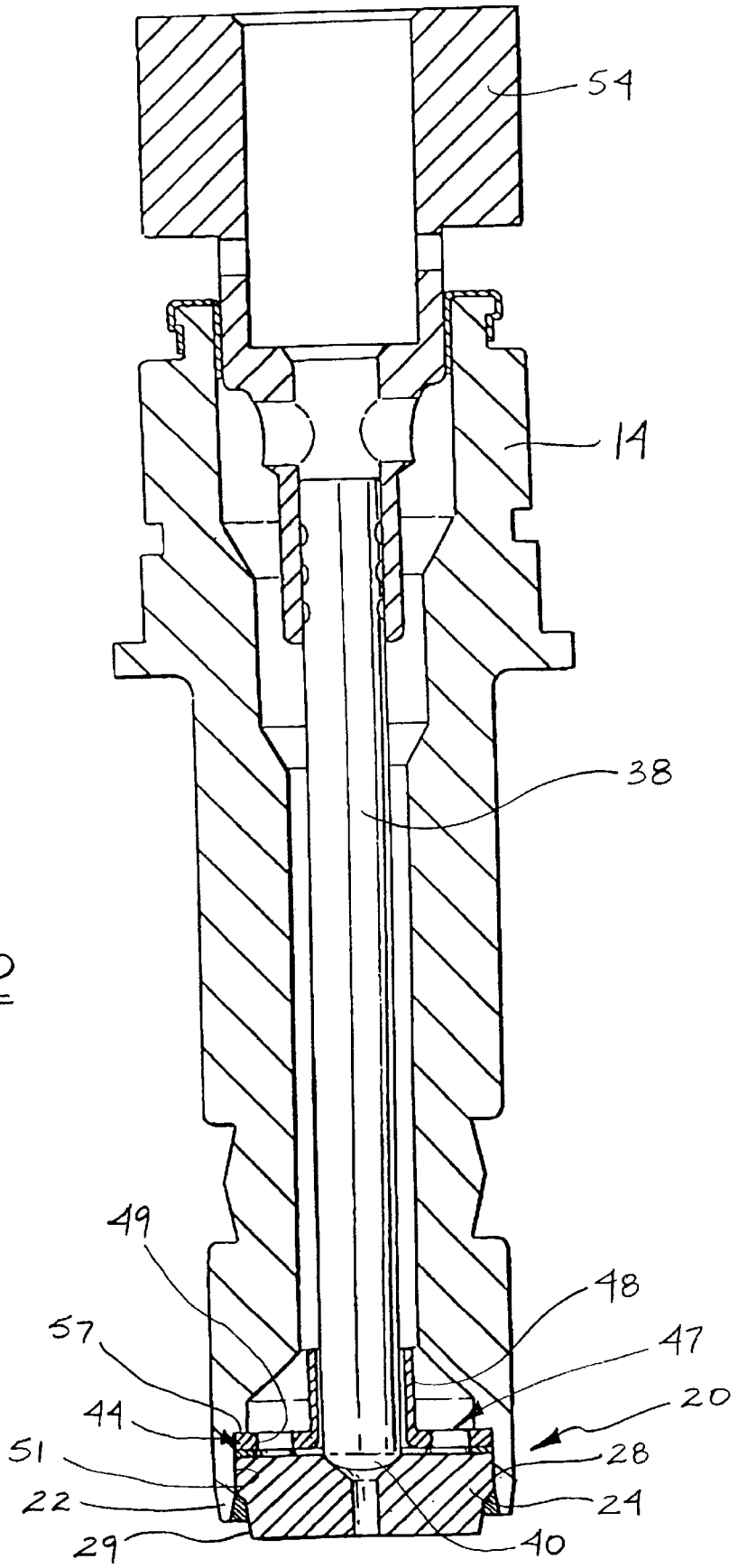
FIG. 2 is a sectional view of a valve body assembly of the fuel injector of FIG. 1 illustrating a valve seat subassembly mounted at one end of the valve body.
Figure 3:
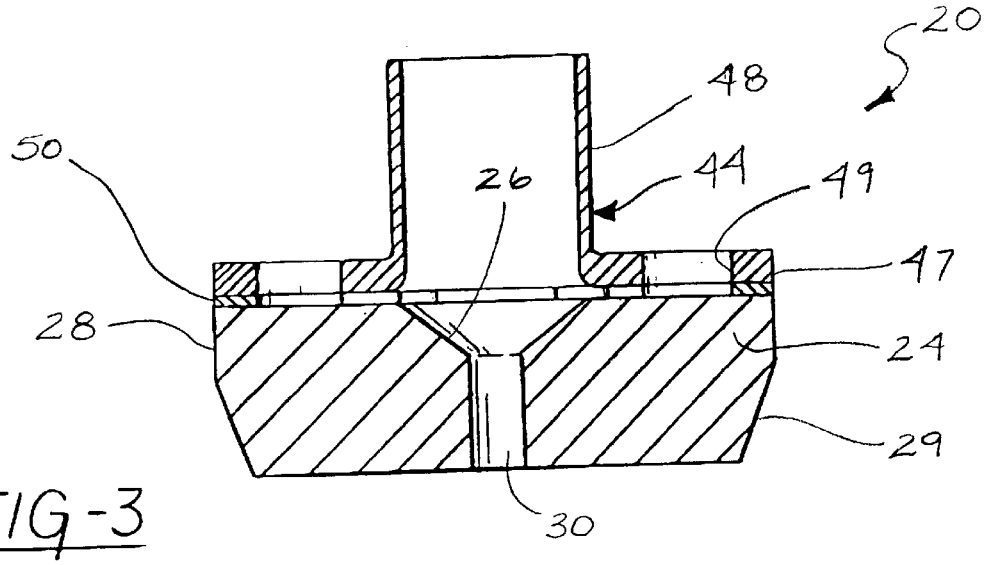
FIG. 3 is an enlarged sectional view of the valve seat subassembly illustrating the assembly of a valve seat, swirl disk and lower needle guide.
Figure 4:
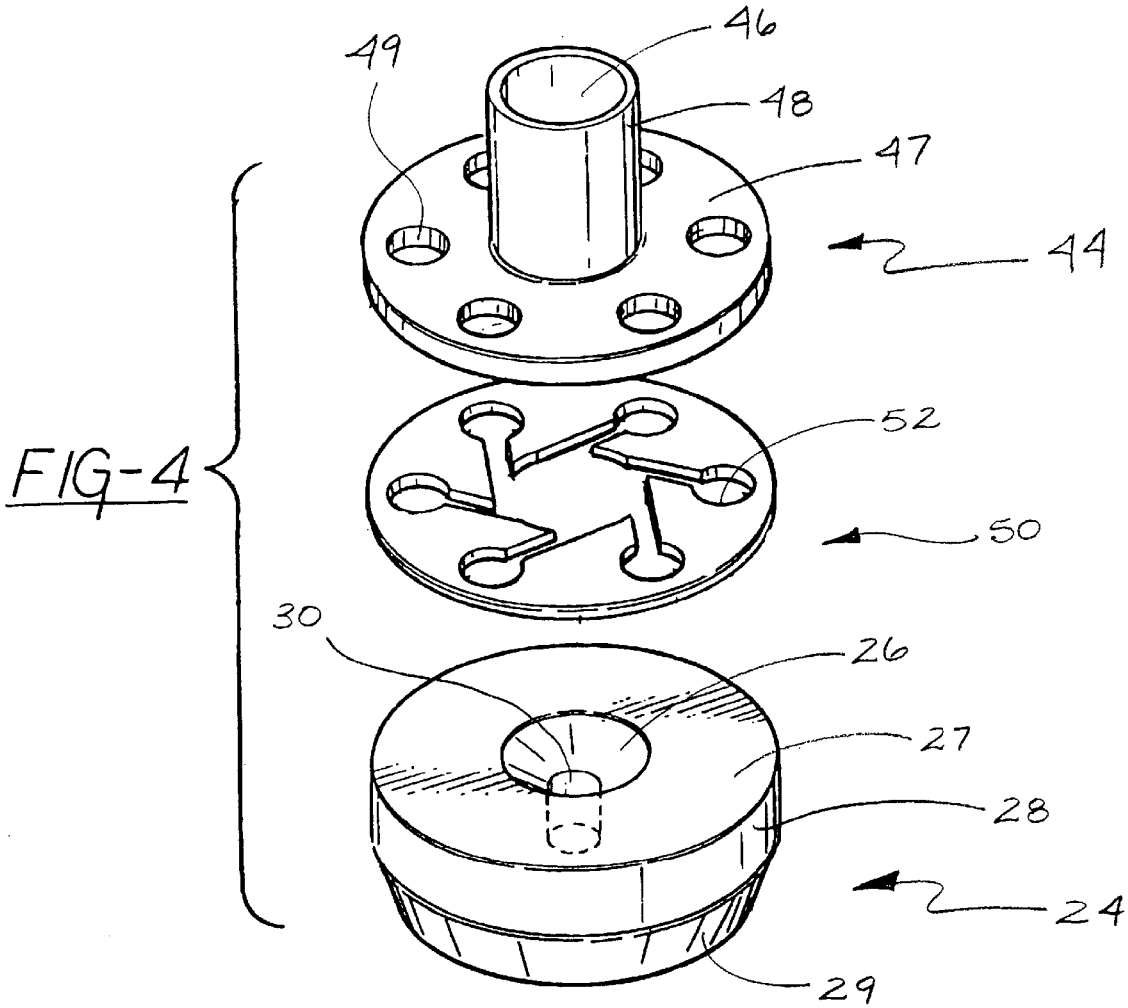
FIG. 4 is an exploded perspective view of the valve seat subassembly illustrating sealing and seating surfaces and a fuel outlet opening, the lower guide having a tubular bore and annular apertures and the swirl disk having a plurality of flow passages.

Referring now to the drawings in detail, numeral 10 generally indicates a solenoid actuated fuel injector of the top feed type for use with an internal combustion engine. The fuel injector 10 includes a housing 12 having a longitudinal axis A and a valve body 14 fixed to the housing. The valve body 14 has a cylindrical sidewall 16 coaxial with the longitudinal axis A that laterally bounds the interior of the valve body 14.

A valve seat subassembly 20 mounted on one end, or nose, 22 of the valve body 14 includes a valve seat 24 having a seating surface 26 and a sealing surface 27 surrounding the seating surface and a peripheral sidewall 28 having a tapered end 29. The seating and sealing surfaces 26, 27 face the interior of the valve body 14. The seating surface 26 is of a frustoconical or concave shape and includes a fuel outlet opening 30 centered on the axis A and is in communication with an inlet connector or fuel tube 32 for conducting pressurized fuel into the valve body 14 against the seating surface 26.

Fuel tube 32 includes a mounting end 34 for mounting the injector in a fuel rail (not shown) as is known. An O-ring 36 is used to seal the mounting end 34 in the fuel rail.

An elongated needle 38 having an end 40, of an arcuate or tapered shape, is disposed along the axis A and movable between a seated position, wherein the end is urged against the seating surface 26 to close the outlet opening against fuel flow, and an open position wherein the end is spaced from the seating surface to allow fuel flow through the outlet opening 30. A spring 42 is provided in valve body 14 for biasing the end 40 toward the seated position.

The valve seat subassembly 20 also includes a lower needle guide 44 of a diameter smaller than the diameter of the valve seat 24 having an axially disposed tubular bore 46 for guiding the needle 38. In the illustrated embodiment, lower needle guide 44 includes a flange portion 47 and a tube portion 48 which includes the tubular bore 46. The tubular bore 46 has a length at least 1.5 times the diameter of the needle and preferably is in the range of 1.5 to 2.0 times the diameter of the needle.

Tubular bore 46 offers a long length interface with the needle 38 and a smooth wear surface. The internal diameter of the tubular bore 46 is controlled to a tight tolerance in relation to the precision ground needle 38 diameter. The increased contact length of the needle 38 and bore 46 combined with the tight tolerance relationship provides improved axial alignment which places the end 40 precisely in the cone of the seating surface 26. This alignment reduces leakage vis-a-vis conventional injectors, allows a desired spray pattern to develop quickly and allows the injector to be closed quickly.

Lower needle guide 44 also includes a plurality of apertures 49 annularly disposed for communicating fuel through the guide.

Preferably valve seat subassembly 20 also includes a swirl disk 50 of a diameter smaller than the diameter of the valve seat 24 and sandwiched between the valve seat sealing surface 27 and the lower guide 44. The valve seat subassembly 20, which includes the valve seat 24, lower guide 44 and swirl disk 50, may have its components laser welded together before assembly into the pocket 51 in the end 22 of the valve body 14.

Swirl disk 50 includes a like plurality of flow passages 52 in communication with the plurality of apertures 49 in lower guide 44 for communicating fuel toward fuel outlet opening 30. The thickness of the flange portion 47 of the lower needle guide 44 is at least as thick as the swirl disk 50 and generally in the range of 1.0 to 2.0 times the thickness of the swirl disk.

An armature 54 connected to needle 38 is ax ally movable in the valve body 14. A solenoid coil 56 is operable to draw the armature 54 away from the valve seat subassembly 20, thereby moving the needle end 40 off the seating surface 26, and allowing fuel to pass through the fuel outlet opening 30.

The valve seat subassembly 20 is assembled in the valve body 14 as follows. The lower guide 44, swirl disk 50 and valve seat 24 are stacked in the pocket 51 against shoulder 57 in the end 22 of the valve body 14. The nose 22 of the valve body is crimped to hold the subassembly therein. The seat 24 is laser welded around its tapered end 29 to fasten the seat subassembly 20 in the end 22 of the valve body 14.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

REFERENCE NUMERALS

10. fuel injector
12. housing
14. valve body
16. sidewall
18.
20. valve seat subassy
22. end (nose)
24. valve seat
26. seating surface
27. sealing surface
28. circum. sidewall
29. tapered end
30. fuel outlet opening
32. inlet connector/fuel tube
34. mounting end
36. O-ring
38. elongated needle
40. distal end
42. spring
44. lower guide
46. tubular bore
47. flange portion
48. tube portion
49. apertures
50. swirl disk
51. pocket
52. flow passages
54. armature
56. solenoid coil
57. shoulder
58. guide pin
60. guide pin
62. weld fixture
64. interior wall
66.
68.
70.
72.
74.
76.
78.
80.
82.
84.
86.
88.
90.
92.
94.
96.
98.

What is claimed is:

1. A solenoid actuated fuel injector for use with an internal combustion engine comprising:

a valve body having a longitudinal axis;

said valve body having an end for mounting a valve seat subassembly; said end including a pocket and a shoulder therein;

a valve seat subassembly mounted on one end of said valve body;

said valve seat subassembly including a valve seat having a seating surface and an annular sealing surface surrounding said seating surface and facing an interior of said valve body;

said seating surface including a fuel outlet opening centered on said axis and in communication with means for conducting pressurized fuel into said valve body against said seating surface;

a needle having a distal end movable between a seated position, wherein the distal end is urged against said seating surface to close the outlet opening and stop fuel flow, and an open position, wherein said distal end is spaced from said seating surface to allow fuel flow through said outlet opening; and biasing means in said valve body and biasing said needle distal end against said seating surface;

said valve seat subassembly also including a lower needle guide having a flange portion and a tube portion;

said tube portion including an axially disposed tubular bore for guiding said needle in a tight tolerance relationship;

said flange portion having a plurality of apertures annularly disposed for communicating fuel through said lower guide.

2. A solenoid actuated fuel injector for use with an internal combustion engine comprising:

a valve body having a longitudinal axis;

said valve body having an end for mounting a valve seat subassembly; said end including a pocket and a shoulder therein;

a valve seat subassembly mounted on one end of said valve body;

said valve seat subassembly including a valve seat having a seating surface and an annular sealing surface surrounding said seating surface and facing an interior of said valve body;

said seating surface including a fuel outlet opening centered on said axis and in communication with means for conducting pressurized fuel into said valve body against said seating surface;

a needle having an axial diameter and a distal end movable between a seated position, wherein the distal end is urged against said seating surface to close the cutlet opening and stop fuel flow, and an open position, wherein said distal end is spaced from said seating surface to allow fuel flow through said outlet opening; and biasing means in said valve body and biasing said needle distal end against said seating surface;

said valve seat subassembly also including a lower needle guide having a flange portion and a tube portion;

said tube portion including an axially disposed tubular bore for guiding said needle in a tight tolerance relationship, said tubular bore having a length greater than 1.5 times the diameter of said needle; and said flange portion having a plurality of apertures annularly disposed for communicating fuel through said lower guide.

3. The fuel injector of claim 2 wherein said valve seat subassembly further includes a swirl disk sandwiched between said valve seat sealing surface and said lower guide flange portion;

said swirl disk including a plurality of flow passages in communication with said apertures in said flange portion for communicating fuel toward said fuel outlet opening.

4. The fuel injector of claim 3 wherein said needle guide flange portion has a thickness at least as thick as said swirl disk.

5. The fuel injector of claim 3 wherein said tube portion has a length 1.5 to 2.0 times the diameter of said needle.

6. The fuel injector of claim 1 wherein said valve seat has a peripheral sidewall having a tapered end spaced from said seating surface.

7. The fuel injector of claim 1 wherein said valve seat subassembly includes a laser weld connecting said valve seat and said lower guide.

* * * * *